US009845687B2

(12) United States Patent
Willey et al.

(10) Patent No.: US 9,845,687 B2
(45) Date of Patent: Dec. 19, 2017

(54) GAS TURBINE ENGINE COMPONENT HAVING PLATFORM COOLING CHANNEL

(71) Applicant: UNITED TECHNOLOGIES CORPORATION, Farmington, CT (US)

(72) Inventors: Lawrence J. Willey, East Hampton, CT (US); Matthew S. Gleiner, Norwalk, CT (US); Russell Deibel, Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 20 days.

(21) Appl. No.: 15/056,116

(22) Filed: Feb. 29, 2016

(65) Prior Publication Data

US 2016/0245096 A1 Aug. 25, 2016

Related U.S. Application Data

(63) Continuation of application No. 13/539,977, filed on Jul. 2, 2012, now Pat. No. 9,303,518.

(51) Int. Cl.

| | |
|---|---|
| ***F01D 5/18*** | (2006.01) |
| ***F01D 9/06*** | (2006.01) |
| ***F01D 9/04*** | (2006.01) |
| ***F01D 25/12*** | (2006.01) |
| ***F04D 29/32*** | (2006.01) |
| ***F04D 29/54*** | (2006.01) |
| ***F04D 29/58*** | (2006.01) |

(52) U.S. Cl.

CPC ..... *F01D 5/187* (2013.01); *F01D 9/041* (2013.01); *F01D 25/12* (2013.01); *F04D 29/324* (2013.01); *F04D 29/542* (2013.01); *F04D 29/582* (2013.01); *F01D 5/188* (2013.01); *F01D 9/06* (2013.01); *F05D 2220/32* (2013.01); *F05D 2230/21* (2013.01); *F05D 2240/55* (2013.01); *F05D 2240/81* (2013.01)

(58) Field of Classification Search

CPC ..... F01D 5/186; F01D 5/187; F01D 5/188; F01D 5/189; F01D 9/06; F01D 9/065; F05D 2240/81; F05D 2260/201; F05D 2260/202; F05D 2260/20

USPC ..... 415/115–116, 135–136, 138–139; 416/95, 96 R, 96 A, 97 R, 193 A

See application file for complete search history.

(56) References Cited

U.S. PATENT DOCUMENTS

| | | | |
|---|---|---|---|
| 4,693,667 | A | 9/1987 | Lenz et al. |
| 4,712,979 | A | 12/1987 | Finger |
| 4,749,333 | A | 6/1988 | Bonner et al. |

(Continued)

OTHER PUBLICATIONS

International Preliminary Report on Patentability for International application No. PCT/US2013/047223 dated Jan. 15, 2015.

(Continued)

*Primary Examiner* — Christopher Verdier

(74) *Attorney, Agent, or Firm* — Carlson, Gaskey & Olds

(57) ABSTRACT

A component for a gas turbine engine includes a platform having an outer surface and an inner surface. A cover plate can be positioned adjacent to the outer surface of the platform. The outer surface of the platform can include a pocket and the cover plate is positioned relative to the pocket to establish a platform cooling channel therebetween.

15 Claims, 3 Drawing Sheets

(56) References Cited

U.S. PATENT DOCUMENTS

| | | | | |
|---|---|---|---|---|
| 4,767,260 | A | 8/1988 | Clevenger et al. | |
| 5,145,315 | A | 9/1992 | North et al. | |
| 5,480,281 | A * | 1/1996 | Correia | F01D 11/08 415/115 |
| 5,609,466 | A | 3/1997 | North et al. | |
| 5,743,708 | A | 4/1998 | Cunha et al. | |
| 5,746,573 | A | 5/1998 | Junkin et al. | |
| 6,386,825 | B1 | 5/2002 | Burdgick | |
| 6,506,013 | B1 | 1/2003 | Burdgick et al. | |
| 6,517,312 | B1 | 2/2003 | Jones et al. | |
| 6,899,518 | B2 | 5/2005 | Lucas et al. | |
| 6,984,101 | B2 | 1/2006 | Schiavo, Jr. | |
| 8,038,399 | B1 | 10/2011 | Liang | |
| 9,303,518 | B2 * | 4/2016 | Willey | F01D 5/187 |
| 2003/0012647 | A1 | 1/2003 | Shiozaki et al. | |
| 2004/0047725 | A1 * | 3/2004 | Tomita | F01D 11/005 415/116 |
| 2005/0281663 | A1 | 12/2005 | Trindade et al. | |
| 2008/0190114 | A1 | 8/2008 | Surace et al. | |
| 2010/0129196 | A1 | 5/2010 | Johnston et al. | |
| 2011/0229305 | A1 | 9/2011 | Bergman et al. | |
| 2012/0045337 | A1 | 2/2012 | Fedor et al. | |

OTHER PUBLICATIONS

International Search Report and Written Opinion for International application No. PCT/US2013/047223 dated Oct. 14, 2013.

* cited by examiner

GAS TURBINE ENGINE COMPONENT HAVING PLATFORM COOLING CHANNEL

CROSS REFERENCE TO RELATED APPLICATION

This application is a continuation of U.S. patent application Ser. No. 13/539,977, now U.S. Pat. No. 9,303,518, which was filed on Jul. 2, 2012.

BACKGROUND

This disclosure relates generally to a gas turbine engine, and more particularly to a component that can be incorporated into a gas turbine engine. The component includes a cooling channel for cooling a platform of the component.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections of a gas turbine engine may include alternating rows of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes prepare the airflow for the next set of blades. Turbine blades and vanes are examples of components that may need to be cooled via a dedicated source of cooling air in order to withstand the relatively high temperatures of the hot combustion gases that are communicated along the core flow path.

SUMMARY

A component for a gas turbine engine according to an exemplary embodiment of the present disclosure can include a platform having an outer surface and an inner surface that axially extend between a leading edge rail and a trailing edge rail and circumferentially extend between a first mate face and a second mate face. A cover plate can be positioned adjacent to the outer surface of the platform. The outer surface of the platform can include a pocket and the cover plate is positioned relative to the pocket to establish a platform cooling channel therebetween. A slot is formed in one of the first mate face or the second mate face. A seal is received in the slot.

In a further embodiment of the foregoing embodiment, the platform can be an inner diameter platform.

In a further embodiment of either of the foregoing embodiments, the component can be a turbine vane.

In a further embodiment of any of the foregoing embodiments, at least a portion of the pocket can be exposed to establish the platform cooling channel.

In a further embodiment of any of the foregoing embodiments, the portion of the pocket can be a side opening of the pocket that faces toward the slot.

In a further embodiment of any of the foregoing embodiments, the pocket can be a cast feature of the platform.

In a further embodiment of any of the foregoing embodiments, the platform cooling channel can be bound by the cover plate and the pocket on all but a single side.

In a further embodiment of any of the foregoing embodiments, the platform cooling channel extends adjacent to a pressure side of an airfoil that extends from the platform.

In a further embodiment of any of the foregoing embodiments, a pocket wall can extend between the pocket and the slot.

In a further embodiment of any of the foregoing embodiments, the pocket can be enclosed by the cover plate to establish the platform cooling channel.

In a further embodiment of any of the foregoing embodiments, the platform cooling channel can include a platform cooling cavity.

In a further embodiment of any of the foregoing embodiments, the cover can include a bent portion that encloses the opening of the pocket.

In a further embodiment of any of the foregoing embodiments, a plurality of openings extend through the ben portion of the cover plate.

In a further embodiment of any of the foregoing embodiments, the seal is a featherseal.

In a further embodiment of any of the foregoing embodiments, the seal abuts a flat surface of a pocket wall disposed between the pocket and the slot.

In a further embodiment of any of the foregoing embodiments, a gap extends between the seal and a flat surface of a pocket wall disposed between the pocket and the slot.

A component for a gas turbine engine according to yet another exemplary embodiment of the present disclosure includes a platform having an outer surface and an inner surface and a cover plate positioned adjacent to the outer surface of the platform. The outer surface of the platform can include a pocket that is enclosed by the cover plate to establish a first platform cooling cavity therebetween. A slot is adjacent to the pocket. A pocket wall is disposed between the pocket and the slot.

In a further embodiment of the foregoing embodiment, the cover plate can include a bent portion that encloses an opening of the pocket.

In a further embodiment of either of the foregoing embodiments, the first platform cooling cavity can be axially bound by a leading edge wall and a trailing edge wall of the pocket and can be circumferentially bound by a circumferential wall of the pocket and a bent portion of the cover plate.

In a further embodiment of any of the foregoing embodiments, the pocket can be circumferentially offset from a mate face of the platform.

The various features and advantages of this disclosure will become apparent to those skilled in the art from the following detailed description. The drawings that accompany the detailed description can be briefly described as follows.

DETAILED DESCRIPTION

Figure 1:
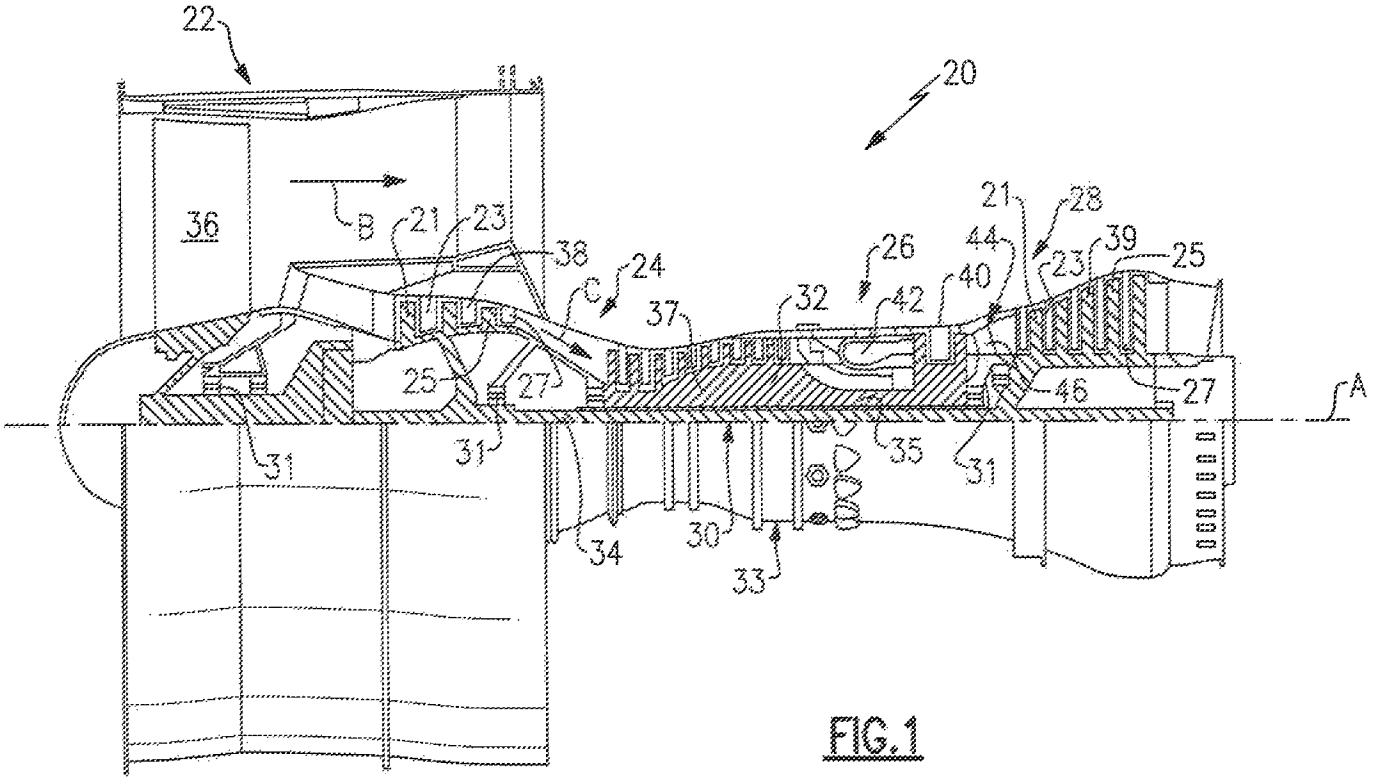
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28 for powering numerous gas turbine engine loads. Although depicted as a turbofan gas turbine engine in this non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that additional bearing systems may alternatively or additionally be provided.

The low speed spool 30 generally includes an inner shaft 34 that interconnects a fan 36, a low pressure compressor 38 and a low pressure turbine 39. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 that can be positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 supports one or more bearing systems 31 of the turbine section 28. The mid-turbine frame 44 may include one or more airfoils 46 that may be positioned within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective low speed spool 30 and the high speed spool 32 in response to the expansion.

Each of the compressor section 24 and the turbine section 28 may include alternating rows of rotor assemblies and vane assemblies (shown schematically). The rotor assemblies carry one or more rotating blades 25, while each vane assembly can carry one or more vanes 27. The blades 25 of each rotor assembly create or extract energy (in the form of pressure) from core airflow that is communicated through the gas turbine engine 20. The vanes 27 of each vane assembly direct airflow to the blades of the rotor assemblies to either add or extract energy.

Various components of the gas turbine engine 20, including but not limited to the vanes 27 and blades 25 of the compressor section 24 and the turbine section 28, may be subjected to repetitive thermal cycling under widely ranging temperatures and pressures. The components of the turbine section 28 are particularly subjected to relatively extreme operating conditions. Therefore, these and other components may be cooled via a dedicated source of cooling air in order to withstand the relatively extreme operating conditions that are experienced within the core flow path C.

Figure 2:
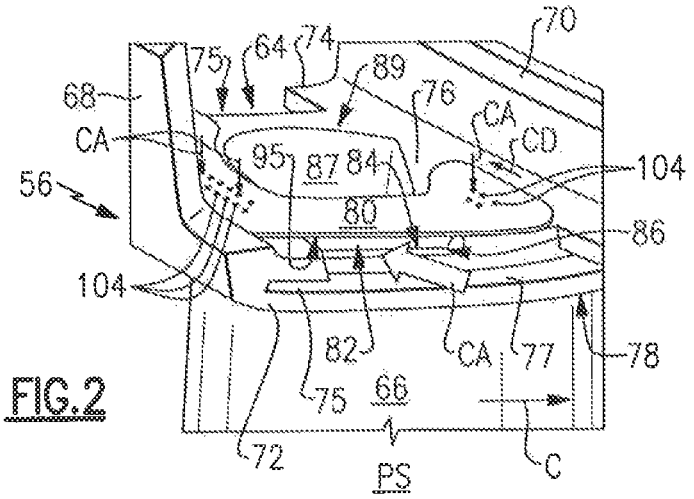
FIG. 2 illustrates a component that can be incorporated into a gas turbine engine.
Figure 3:
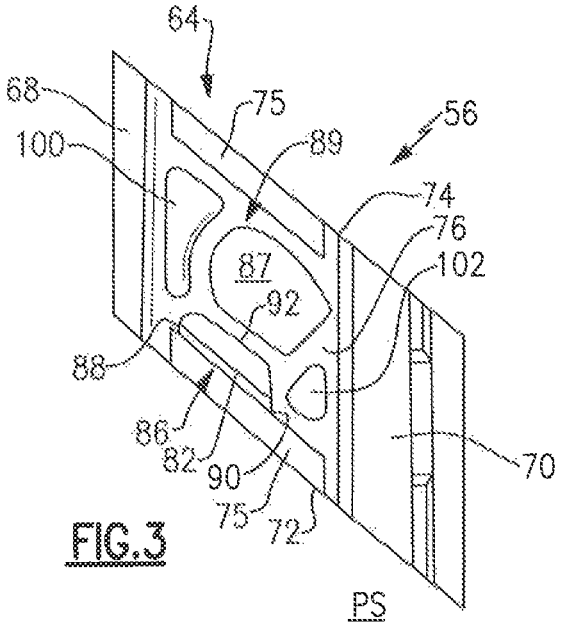
FIG. 3 illustrates a bottom view of the component of FIG. 2.

FIGS. 2 and 3 illustrate a component 56 that can be incorporated into a gas turbine engine, such as the gas turbine engine 20 of FIG. 1. In this exemplary embodiment, the component 56 is a turbine vane. However, the teachings of this disclosure are not limited to turbine vanes and could extend to other components of the gas turbine engine 20, including but not limited to, compressor blades and vanes, turbine blades, or other components.

The component 56 includes a platform 64 and an airfoil 66 that extends from the platform 64. In this disclosure, the term "platform" encompasses both outer diameter platforms and inner diameter platforms. The platform 64 of this embodiment is an inner diameter platform. It should be understood that the component 56 can also include an outer diameter platform (not shown) on an opposite side of the airfoil 66 from the platform 64.

The platform 64 includes a leading edge rail 68, a trailing edge rail 70 and opposing mate faces 72, 74. The platform 64 axially extends between the leading edge rail 68 and the trailing edge rail 70 and circumferentially extends between the opposing mate faces 72, 74. The opposing mate faces 72, 74 can be positioned relative to similar mate faces of adjacent components of the gas turbine engine 20 to provide a full ring assembly, such as a full ring vane assembly, that can be circumferentially disposed about the engine centerline longitudinal axis A of the gas turbine engine 20.

In one exemplary embodiment, the opposing mate faces 72, 74 include a slot 75 that receives a seal 77 (FIG. 2). The seal 77 extends between the adjacent mate faces of neighboring components of a full ring assembly and prevents airflow leakage into and/or out of the core flow path C. The seal 77 may include a featherseal or any other seal.

The platform 64 includes an outer surface 76 and an inner surface 78. When the component 56 is mounted within the gas turbine engine 20, the outer surface 76 is positioned on a non-core flow path side of the component 56, and the inner surface 78 establishes an inner boundary of the core flow path C of the gas turbine engine 20. The component 56 can further include a cover plate 80 (shown removed in FIG. 3) that is positioned relative to the outer surface 76 of the platform 64. A plurality of cooling channels can extend between the cover plate 80 and the outer surface 76. These cooling channels can be provided with dedicated cooling air to cool the platform 64, as is further discussed below.

An opening 89 of an internal core 87 of the airfoil 66 can protrude through the outer surface 76 of the platform 64. The opening 89 directly receives cooling air to cool the internal surfaces of the airfoil 66. The cover plate 80 can partially surround the opening 89 without covering the opening 89 such that cooling air can be directly communicated into the internal core 87. In this manner, both the platform 64 and the airfoil 66 can be cooled using dedicated cooling air.

The platform 64 includes a pocket 82 that can be formed into the outer surface 76. In one exemplary embodiment, the pocket 82 is a cast feature of the platform 64. However, the pocket 82 could also be a machined feature of the platform 64, or could be formed using any other known manufacturing techniques.

In this exemplary embodiment, the pocket 82 is circumferentially offset (in a circumferential direction CD) from the mate face 72 adjacent to a pressure side PS of the airfoil 66. This is but one example embodiment of the pocket 82. It should be understood that other configurations are contemplated. For example, the pocket 82 could be positioned at any location of the platform 64, including but not limited to, adjacent to the leading edge rail 68, the trailing edge rail 70, or the opposing mate face 74. Multiple pockets 82 could also be formed on the outer surface 76.

The cover plate 80 is positioned radially outwardly relative to the pocket 82 to establish a platform cooling channel 84. In this exemplary embodiment, a portion of the pocket 82 is uncovered by the cover plate 80 such that cooling air CA can be circulated through the platform cooling channel 84 to cool the platform 64. In other words, the pocket 82 is exposed to cooling air CA. In the illustrated embodiment, the cooling air CA is communicated into the platform cooling channel 84 through a side opening 86 of the pocket 82. The side opening 86 faces the mate face 72 and axially extends parallel to the mate face 72.

The platform cooling channel 84 is bound by the pocket 82 and the cover plate 80 on all but a single side. The pocket 82 includes a leading edge axial wall 88, a trailing edge axial wall 90, a circumferential wall 92, and a floor 93 (See FIG. 4). In this exemplary embodiment, the portion of the pocket 82 opposite from the circumferential wall 92 is the exposed portion, or side opening 86, of the pocket 82. The platform cooling channel 84 axially extends on a pressure side PS of the airfoil 66 between the leading edge axial wall 88 and the trailing edge axial wall 90, and radially extends between the floor 93 and an inner surface 95 of the cover plate 80. The platform cooling channel 84 can embody other designs and configurations within the scope of this disclosure.

The component 56 can include additional cooling channels 100, 102. Any number of cooling channels could be provided on the platform 64. In this exemplary embodiment, at least one of the cooling channels 100, 102 is an impingement cooling cavity. Cooling air CA can be directed through openings 104 of the cover plate 80 to impingement cool the platform 64 within the cooling channels 100, 102. For example, a plurality of openings 104 through the cover plate 80 can redirect the cooling air to form jets of air that perpendicularly impact the cooling channels 100, 102 in order to cool the platform 64 in the area encompassed by the cooling channels 100, 102.

Figure 4:
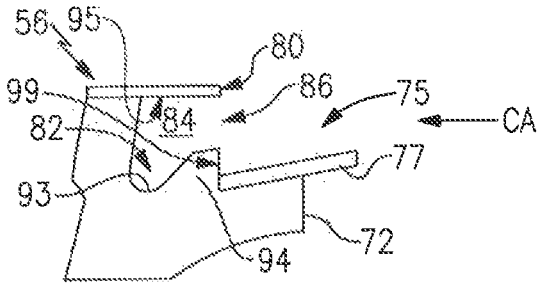
FIG. 4 illustrates a cross-sectional view through a component.

The cross-sectional view of FIG. 4 (viewed looking from leading edge rail 68 toward trailing edge rail 70) illustrates the seal 77 received within the slot 75 of the mate face 72. A pocket wall 94 extends between the pocket 82 and the slot 75 of the mate face 72. The seal 77 can abut a flat surface 99 of the pocket wall 94. The flat surface 99 of this embodiment faces toward the mate face 72.

Figure 5:
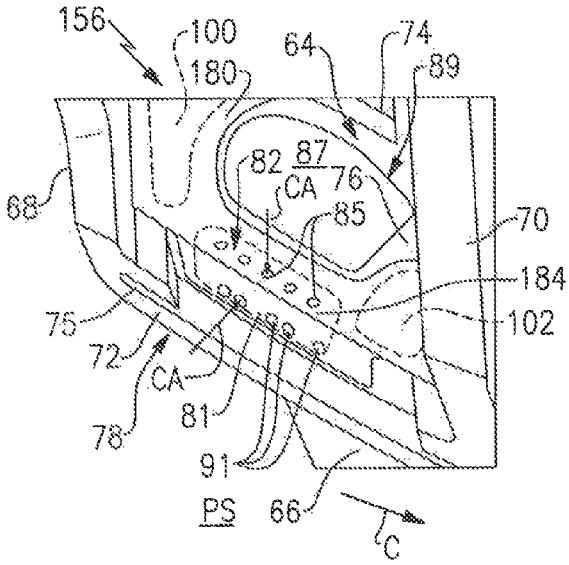
FIG. 5 illustrates another component that can be incorporated into a gas turbine engine.
Figure 6:
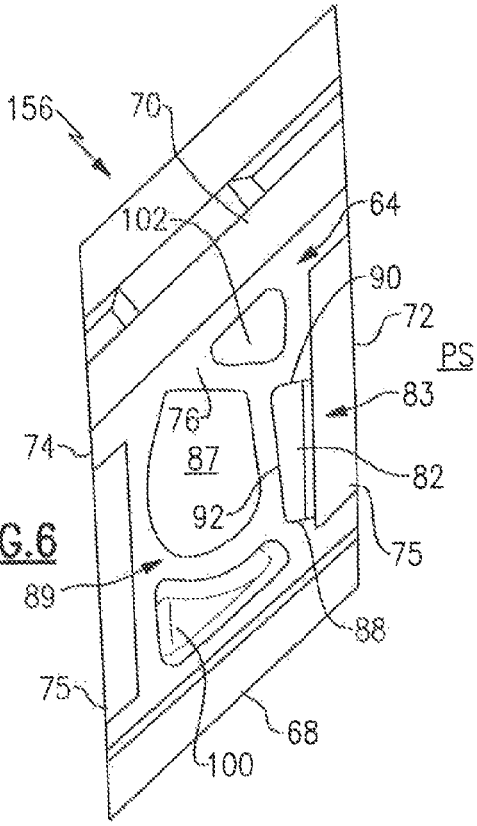
FIG. 6 illustrates a bottom view of the component of FIG. 5.

FIGS. 5 and 6 illustrate a portion of another component 156 that can be incorporated into a gas turbine engine, such as the gas turbine engine 20 of FIG. 1. In this exemplary embodiment, the component 156 is a turbine vane. However, the teachings of this disclosure are not limited to turbine vanes and could extend to other components of the gas turbine engine 20, including but not limited to, compressor blades and vanes, turbine blades, or other components. In this disclosure, like reference numerals signify like features, and reference numerals modified by "100" signify slightly modified features.

The exemplary component 156 is similar to the component 56 that includes a platform 64 and an airfoil 66 (See FIG. 2) that extends from the platform 64. The platform 64 of this embodiment is an inner diameter platform. It should be understood that the component 156 can also include an outer diameter platform (not shown) on an opposite side of the airfoil 66 from the platform 64.

The platform 64 includes a leading edge rail 68, a trailing edge rail 70 and opposing mate faces 72, 74. The platform 64 axially extends between the leading edge rail 68 and the trailing edge rail 70 and circumferentially extends between the opposing mate faces 72, 74. The opposing mate faces 72, 74 can be positioned relative to similar mate faces of adjacent components of the gas turbine engine 20 to provide a full ring assembly, such as a full ring vane assembly, that can be circumferentially disposed about the engine centerline longitudinal axis A of the gas turbine engine 20.

Figure 7:
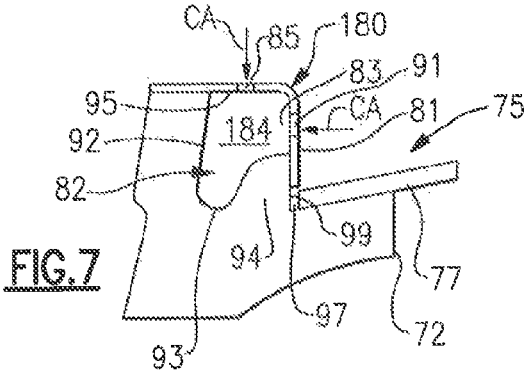
FIG. 7 illustrates a cross-sectional view of a platform cooling cavity of the component of FIG. 5.
Figure 8:
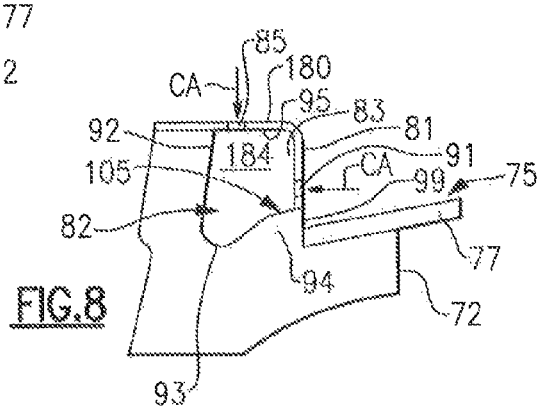
FIG. 8 illustrates another exemplary platform cooling cavity.

In one exemplary embodiment, the opposing mate faces 72, 74 include a slot 75 that can receive a seal 77 (See FIGS. 7 and 8). The seal 77 extends between the adjacent mate faces of neighboring components of a full ring assembly and prevents airflow from leaking into and/or out of the core flow path C. The seal 77 may include a featherseal or any other seal.

The platform 64 also includes an outer surface 76 and an inner surface 78. When the component 56 is mounted within the gas turbine engine 20, the outer surface 76 is positioned on a non-core flow path side of the component 56, and the inner surface 78 establishes an inner boundary of the core flow path C of the gas turbine engine 20. The component 56 can further include a cover plate 180 (shown removed in FIG. 6) that is positioned relative to the outer surface 76 of the platform 64. A plurality of cooling channels can extend between the cover plate 180 and the outer surface 76. These cooling channels can be provided with dedicated cooling air CA to cool the platform 64, as is further discussed below.

An opening 89 of an internal core 87 of the airfoil 66 can protrude through the outer surface 76 of the platform 64. The opening 89 can directly receive cooling air to cool the internal surfaces of the airfoil 66. The cover plate 180 can partially surround the opening 89 without covering the opening 89 such that cooling air can be directly communicated into the internal core 87. In this manner, both the platform 64 and the airfoil 66 can be provided with dedicated cooling air.

The cover plate 180 is positioned radially outwardly relative to a pocket 82 to establish a first platform cooling cavity 184 (i.e., an enclosed platform cooling channel). The pocket 82 can be located at a position that is circumferentially offset from the mate face 72 of the platform 64. In this exemplary embodiment, the cover plate 180 encloses the pocket 82 to establish the first platform cooling cavity 184. In other words, unlike the first platform cooling cavity 84 of the FIG. 2 embodiment, the first platform cooling cavity 184 is a closed cavity. The cover plate 180 can include a bent portion 81 that encloses a side opening 83 of the pocket 82.

The cover plate 180 can include a plurality of openings 85 that extend through the cover plate 180 to direct cooling air CA into the first platform cooling cavity 184 to cool the platform 64. For example, the plurality of openings 85 can redirect the cooling air CA to form jets of air that perpendicularly impact a bottom surface of a platform cooling cavity within the platform 64 to impingement cool the platform 64 within the first platform cooling cavity 184. A portion 91 of the plurality of openings 85 may extend through the bent portion 81 of the cover plate 180.

The first platform cooling cavity 184 is bound by the pocket 82 and the cover plate 180 on all sides. The pocket 82 includes a leading edge axial wall 88, a trailing edge axial wall 90, a circumferential wall 92, and a floor 93 (See FIG. 4). The first platform cooling cavity 184 axially extends on a pressure side PS of the airfoil 66 between the leading edge axial wall 88 and the trailing edge axial wall 90, radially extends between the floor 93 and an inner surface 95 of the cover plate 180, and circumferentially extends between the circumferential wall 92 of the pocket 82 and the bent portion 81 of the cover plate 180. The first platform cooling cavity 184 can embody other designs and configurations within the scope of this disclosure.

The component 156 can further include additional cooling cavities 100, 102 (i.e., second and third platform cooling cavities). Any number of cooling cavities could be disposed on the platform 64. In this exemplary embodiment, the cooling cavity 100 is an impingement cooling cavity that receives cooling air CA. However, the cooling cavities 100, 102 are not necessarily limited to impingement cooling cavities.

The cross-sectional view of FIG. 7 (viewed looking in a direction from the leading edge rail 68 toward the trailing edge rail 70) illustrates the seal 77 received within the slot 75 of the mate face 72. A pocket wall 94 extends between the pocket 82 and the slot 75 of the mate face 72. In this embodiment, a gap 97 extends between the seal 77 and a flat surface 99 of the pocket wall 94. The flat surface 99 faces toward the mate face 72.

The bent portion 81 of the cover plate 180 can be attached to the flat surface 99 of the pocket wall 94. In one exemplary embodiment, the bent portion 81 is welded to the pocket wall 94. Alternatively, as shown in the FIG. 8, the bent portion 81 can be attached to a radially outer surface 105 of the pocket wall 94 and the seal 77 can abut the flat surface 99 of the pocket wall 94. Other attachment locations, designs and configurations are also contemplated as within the scope of this disclosure.

Although the different non-limiting embodiments described herein are illustrated as having specific components, the embodiments of this disclosure are not limited to those particular combinations. It is possible to use some of the components or features from any of the non-limiting embodiments in combination with features or components from any other non-limiting embodiments.

It should also be understood that like reference numerals identify corresponding or similar elements within the several drawings. It should further be understood that although a particular component arrangement is disclosed and illustrated in these exemplary embodiments, other arrangements can also benefit from the teachings of this disclosure.

The foregoing description shall be interpreted as illustrative and not in any limiting sense. A worker of ordinary skill in the art would recognize that various modifications could come within the scope of this disclosure. For these reasons, the following claims should be studied to determine the true scope and content of this disclosure.

What is claimed is:

1. A component for a gas turbine engine, comprising:

a platform having an outer surface and an inner surface that axially extend between a leading edge rail and a trailing edge rail and circumferentially extend between a first mate face and a second mate face;

a cover plate positioned adjacent to said outer surface of said platform, wherein said outer surface of said platform includes a pocket and said cover plate is positioned relative to said pocket to establish a platform cooling channel therebetween;

a slot in one of said first mate face and said second mate face; and a seal received within said slot, and said seal abuts a pocket wall circumferentially disposed between said pocket and said slot, wherein said pocket and said slot are fluidly connected to one another.

2. The component as recited in claim 1, wherein said platform is an inner diameter platform.

3. The component as recited in claim 1, wherein the component is a turbine vane.

4. The component as recited in claim 1, wherein at least a portion of said pocket is exposed to establish said platform cooling channel.

5. The component as recited in claim 4, wherein said portion of said pocket is a side opening of said pocket that faces toward said slot.

6. The component as recited in claim 1, wherein said pocket is a cast feature of said platform.

7. The component as recited in claim 1, wherein said platform cooling channel is bound by said cover plate and said pocket on all but a single side.

8. The component as recited in claim 1, wherein said platform cooling channel extends adjacent to a pressure side of an airfoil that extends from the platform.

9. The component as recited in claim 1, wherein said pocket is enclosed by said cover plate to establish said platform cooling channel.

10. The component as recited in claim 1, wherein said platform cooling channel is a platform cooling cavity.

11. The component as recited in claim 1, wherein said cover plate includes a bent portion that encloses an opening of said pocket.

12. The component as recited in claim 11, comprising a plurality of openings extending through said bent portion of said cover plate.

13. The component as recited in claim 1, wherein said seal is a featherseal.

14. The component as recited in claim 1, wherein said seal abuts a flat surface of said pocket wall.

15. The component as recited in claim 1, wherein said pocket and said slot are fluidly connected through an opening of said pocket.

* * * * *